United States Patent [19]

Winterbottom et al.

[11] 4,310,327

[45] Jan. 12, 1982

[54] WET TRANSFER PRINTING

[75] Inventors: Malcolm L. Winterbottom, Hayfield; Donald W. H. Burtonshaw, Stockport, both of England

[73] Assignee: Transprints (U.K.) Limited, Manchester, England

[21] Appl. No.: 87,032

[22] Filed: Oct. 22, 1979

[51] Int. Cl.[3] ..... D06P 3/14

[52] U.S. Cl. ..... 8/467; 8/468; 8/919

[58] Field of Search ..... 8/2.5 R, 54, 2.5 A

[56] References Cited

U.S. PATENT DOCUMENTS

| | | | |
|---|---|---|---|
| 3,666,397 | 5/1972 | Datye et al. | 8/2.5 A |
| 3,730,676 | 5/1973 | Smith et al. | 8/2.5 A |
| 4,057,864 | 11/1977 | Wild | 8/2.5 R |
| 4,105,400 | 8/1978 | Back | 8/2.5 R |
| 4,119,398 | 10/1978 | Purser | 8/2.5 R |
| 4,155,707 | 5/1979 | Franceschim et al. | 8/2.5 R |

FOREIGN PATENT DOCUMENTS 1243223 8/1971 United Kingdom .

OTHER PUBLICATIONS

Hall, A. J., Textile Manufacturer, 1974, 101, (No. 1196), pp. 44–51.

Vellins, C. E., "Transfer Printing" in Venkataraman's The Chemistry of Synthetic Dyes, 1978, (Academic Press), vol. VIII, pp. 191–220.

*Primary Examiner*—A. Lionel Clingman

*Attorney, Agent, or Firm*—Stevens, Davis, Miller & Mosher

[57] ABSTRACT

In an improved method for the wet transfer printing of wool or wool-rich fabric the untreated fabric has introduced into it, as part of the wet transfer printing process, chlorine or a chlorine donor. The chlorine or chlorine donor is introduced before dye is transferred to the fabric, and when a chlorine donor is used as impregnating liquor for wet-transfer printing can be used to release chlorine from the donor.

5 Claims, 1 Drawing Figure

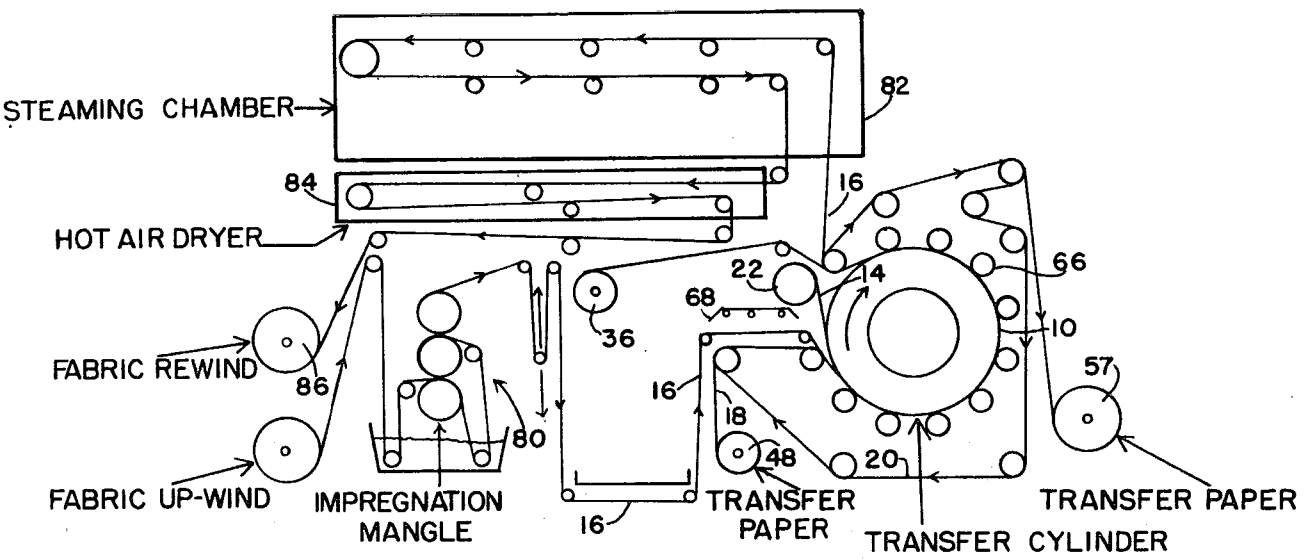
TRANSFER PAPER
TRANSFER CYLINDER
TRANSFER PAPER
IMPREGNATION MANGLE
FABRIC UP-WIND
FABRIC REWIND
HOT AIR DRYER
STEAMING CHAMBER
57
10
66
20
14
16
82
22
68
18
48
16
16
36
80
86
84

WET TRANSFER PRINTING

DESCRIPTION

The present invention is concerned with wet transfer printing of materials, especially wool and wool rich fabrics.

Conventional wet transfer printing processes comprise printing the design on paper with suitable dyestuffs, impregnating the fabric to be printed with an aqueous solution which may for example contain a dye fixation catalyst and a thickener, and bringing the paper and the fabric into close contact by applying pressure and heat to transfer the dye from the paper to the fabric and to fix it in the same operation.

It is well-known to print by a wet transfer process fabrics consisting wholly or mainly of wool. Examples of such processes are described in U.K. Patent Specifications Nos. 1227271 and 1243223 and particularly in U.K. Pat. No. 1284824 which describes the so-called FASTRAN process. However, for the prints resulting from such processes to have commercial acceptability; the woollen or wool rich fabric has been required to have been pre-treated to render the fabric more receptive to the dyestuffs employed. One such treatment is the well-known technique of chlorination, others being the pre-treatment with proprietary chemicals such as FICHLOR and BASOLAN. All such treatments have been traditionally slow, complicated and expensive.

The cost and inconvenience resulting from the employment of these processes has been a significant contributory factor in the relatively restrained production of date of printed woollen goods. If untreated wool is subjected to a conventional printing process, whether by transfer printing or other known printing processes, the resulting prints are of much reduced colour yield and are of a pronounced skittery appearance compared with those produced on wool pre-treated by one of the aforementioned techniques.

It has now been discovered that a considerable and unexpected improvement in dye yield and print quality can be obtained using untreated wool or wool rich fabrics if chlorine, or a chlorine donor, is introduced into the fabric within the wet transfer printing process itself rather than by a separate pre-treatment process. The success of this technique is particularly unexpected since expert opinion has for many years been that the pre-treatment required to obtain satisfactory print quality was subject to multifarious critical reaction conditions which of necessity resulted in a slow, complicated and expensive process.

In the simplest embodiment of this invention, chlorine or a chlorine donor, is added to the impregnation solution which is used as part of the conventional wet transfer printing process to wet the fabric immediately prior to its being brought into contact with the transfer paper. By virtue of this step, prints of quality similar to those obtained using pre-treated fabric are obtained without the extra pre-treatment processing, thereby enabling meaningful economies in cost and convenience to be effected.

In a preferred embodiment, the chlorine donor is introduced into the untreated woollen fabric separately from the impregnating liquor but immediately prior to the impregnation step, impregnation being effected by passing the fabric through a liquor coating device immediately prior to being brought into contact with the transfer paper. The liquor applied by the coating device contains, in accordance with known practice, an acid which is effective to release the free chlorine into the wool. By this technique, the possibility of releasing free chlorine gas into the atmosphere is substantially eliminated.

The invention is described further hereinafter, by way of example, with reference to the accompanying drawing which is a diagrammatic illustration of an apparatus for performing a known wet transfer printing process to which the present invention is applicable.

The drawing corresponds to FIG. 3 of U.K. Patent Specification No. 1492036 to which attention is hereby directed for a detailed discussion of wet transfer printing. The apparatus illustrated in the drawing comprises a cylinder 10 which is journalled for free rotation about its central longitudinal axis. The cylinder 10 is arranged to be heated to an operating temperature of about 110° C.–125° C., for example by steam at a pressure of approximately 10–30 p.s.i. supplied to the interior of the cylinder 10.

The transfer process involves passing a first web 14 of backing paper (if required) around the cylinder 10 in contact with a second web 16 of wet fabric to which the transfer is to be applied, a third web 18, consisting of the transfer paper bearing the transfer to be printed, being passed around the cylinder in intimate contact with the second web 16. A fourth web, comprising an endless blanket 20 of water impervious, fabric-reinforced rubber, passes around the outside of the three webs 14, 16, 18 to urge these webs against the cylinder 10.

As illustrated, the inner web 14 of backing paper is stored on a roll 22. After passing around the majority of the periphery of the cylinder 10, the inner web 14 is taken up on a roll 36.

The wet fabric web 16, before it reaches the cylinder 10, is passed through an impregnation mangle 80 where it is impregnated with an aqueous solution which may, for example contain a dye fixation catalyst and a thickener. After leaving the cylinder 10, the fabric web 16 may be passed through a steaming chamber 82 and a hot air dries 84 before being collected on a rewind roll 86. In the embodiment illustrated, an infra-red pre-heater 68 is provided for pre-heating the webs 16 and 18 before entry onto the cylinder 10.

The transfer paper web 18 is guided onto the cylinder 10 from a storage roll 48 and subsequently taken up by a roll 57.

In order to provide the necessary pressure on the three webs 14, 16 and 18 to effect transfer of the dye to the fabric web when the webs are being passed around the heated cylinder 10, a plurality of radially displaceable, driven pressure applicators in the form of rollers 65 and located behind the blanket 20 at different points around the periphery of the cylinder 10. The pressure rollers 66 are rotatable about their longitudinal axes by a mechanical drive (not shown) such as a crown wheel and pinions or by a chain. The pressure rollers 66 are adapted to be individually actuable, whereby the actual pressure applied by each roller to the web sandwich between that roller 66 and the cylinder 10 is pre-selectable. By virtue of the pressure rollers 66, a pre-selected pressure distribution can be set up whereby, for example, the webs are subjected to a series of gradually increasing pressure transients as the webs progress around the cylinder.

The present invention may be applied to this known apparatus as follows.

In a first example, chlorine, or a chlorine donor such as sodium hypochlorite, is added to the impregnation solution in the mangle 80. Since the conventional impregnation solution is acidic, when sodium hypochlorite is added free chlorine is released which is therefore introduced into the untreated woollen fabric.

In a second, preferred embodiment the apparatus is modified as explained in our copending Application No. 33049/77 whereby the impregnation solution is not introduced in the mangle 80 but is applied to the web in the form of a thick paste by a coating device disposed in the region of the infra-red heater 68 in the drawing, that is, immediately upstream of the cylinder 10. The chlorine is introduced into the fabric by passing the fabric through a chlorine containing chemical, such as sodium hypochlorite to achieve a measured pick-up of such chemical prior to the fabric reaching the coating device. The hypochlorite solution could thus be added at the position of the mangle in the drawing. The coating liquor contains an acid and can be of the type normally used in the wet transfer printing of wool in accordance with our aforementioned Application No. 33049/77. At the interface of the acidic coating liquor and the chlorine containing solution in the wool, rapid generation of chlorine takes place but this is contained between the fabric and the coating so that free chlorine is not released to the atmosphere but is contained within the machine cylinder and blanket so providing an essentially sealed system. Under the conditions of heat and moisture within the system, chlorination of the wool rapidly occurs thus making the fabric receptive to the dye present on the transfer printing paper and enabling prints to be obtained at quality equal to those hitherto only available using pre-treated wool. This latter embodiment thus has the advantage that the risk of liberating free chlorine to the atmosphere is substantially eliminated.

The invention will now be more particularly described with reference to the following Examples:

EXAMPLE 1

A scoured, but unchlorinated wool serge fabric is impregnated in a solution containing the following ingredients, mixed with a high speed stirrer in the order given.

| | |
|---|---|
| COLD WATER | 854 gm |
| NATRASOL 250 HH (HERCULES POWDER CO) | 15 gm |
| ACETIC ACID (GLACIAL) | 10 gm |
| SODIUM HYPOCHLORITE SOLUTION (120 gm/l available chlorine) | 20 gm |
| NONIDET SH 30 (SHELL CHEMICALS) | 10 gm |
| | 1000 gm |

Natrasol 250 HH is hydroxyethyl cellulose which is a water soluble textile thickening agent. Nonidet SH 30 is a solution of a non-ionic wetting agent.

The resulting solution has a pH of approximately 3.5.

After impregnation in this solution, the fabric is then mangled so that the fabric retains 100–110% of the solution, based on the dry weight of the fabric.

The impregnated fabric which, by this time, smells only faintly of chlorine, is then wet transfer printed on a machine such as the one illustrated in the accompanying drawing and described in detail in U.K. Pat. No. 1,492,036 with the settings as follows:

| | |
|---|---|
| Cylinder Steam Pressure | 3 psi |
| Contact time on heated cylinder | 45 secs |
| Pressure roller settings | 5 psi |

The transfer paper used was printed by a gravure technique such as the Aquatran W paper produced by Transprints (UK) Limited using inks containing suitable dyes such as:

| | | |
|---|---|---|
| C.I. Reactive Yellow 39 | Lanasol Yellow 4G | (Ciba Geigy) |
| C.I. Reactive Red 65 | Lanasol Red B | " |
| C.I. Reactive Blue 69 | Lanasol Blue 3G | " |

The paper/fabric composite was run with the back of the wet fabric against the heated cylinder.

After transferring, the printed fabric was separated from the spent paper and washed for 5 minutes at 45° C. in 1 gm/liter ammonia solution, rinsed in water and dried.

A sample of the same fabric but having been given the conventional pre-chlorination was subjected to the same process but omitting the Sodium Hypochlorite from the impregnating liquor and on comparison both prints were of a similar character. A sample of the same fabric was subjected to the same process but omitting the Sodium Hypochlorite from the impregnating liquor and on comparison with the other examples gave a print of reduced colour yield and of a pronounced skittery appearance.

EXAMPLE 2

A scoured, but unchlorinated wool serge fabric is impregnated in an aqueous solution of sodium hypochlorite containing 3.5 gm/liter available chlorine and adjusted to pH 4.5. with acetic acid. The impregnated fabric is then mangled so that the fabric retains 70% of the solution based on the dry weight of the fabric. Following a delay of from about 30 seconds to about 2 minutes depending on the speed and threading up of the transfer printing calender, the thus impregnated fabric is passed through a liquor coating device such as the one described in Example 1 of Patent application No. 33049/77.

The coating liquor is make up according to the following recipe and yielding a pH of approximately 2.

| | |
|---|---|
| Natrasol 250 HH | 20 gm |
| Sulphamic Acid | 10 gm |
| Sodium Acetate | 5 gm |
| Water | 965 gm |
| | 1000 gm |

The thus treated fabric is then wet transfer printed according to Example 1, except that the paper/fabric composite was run with the back of the transfer paper against the heated cylinder. After transferring, the printed fabric was separated from the spent paper and washed as in Example 1.

The result was comparable in colour yield and fastness to that of a sample of chlorinated wool wet transfer printed by the conventional route, without prior impregnation in the hypochlorite solution. A further sample of the original unchlorinated wool wet transfer printed by the same process but omitting the preliminary impregnation in the solution of sodium hypochlorite and on examination had a such interior dye yield and exhibited a pronounced skittery appearance.

What we claim is:

1. In a process for wet transfer printing a wool or wool rich fabric which comprises impregnating said fabric with an impregnating liquor and bringing a transfer print paper and the fabric into close contact, applying pressure and heat to transfer the dye from the paper to the fabric and fix the dye, the improvement which comprises introducing into the fabric as part of the wet transfer printing process, chlorine or a chlorine donor before transferring the dye from the paper to the fabric.

2. A process according to claim 1 in which the chlorine donor comprises an aqueous solution of a hypochlorite.

3. A process according to claim 1 or 2 in which the chlorine or chlorine donor is added to the impregnating liquor with which the fabric is impregnated during the wet transfer printing process, said liquor releasing chlorine from said chlorine donor.

4. A process according to claim 1 or 2 in which the chlorine or chlorine donor is introduced into the wool or wool rich fabric separately from the impregnating liquor but immediately before the impregnation with said solution.

5. A process according to claim 4 in which the impregnation with said impregnating liquor is effected by passing the fabric through a liquor coating device immediately prior to being brought into contact with the transfer paper, the liquor serving to release chlorine from said chlorine donor.

* * * * *